US006374434B1

(12) United States Patent
Reid

(10) Patent No.: US 6,374,434 B1
(45) Date of Patent: Apr. 23, 2002

(54) THERAPEUTIC SHOWER

(76) Inventor: Donald Lee Reid, 344 N. Birchwood Dr., Hendersonville, TN (US) 37075

( * ) Notice: Subject to any disclaimer, the term of this patent is extended or adjusted under 35 U.S.C. 154(b) by 0 days.

(21) Appl. No.: 09/391,895

(22) Filed: Sep. 7, 1999

(51) Int. Cl.[7] ..... A47K 3/28
(52) U.S. Cl. ..... 4/601; 4/596; 4/604
(58) Field of Search ..... 4/555, 556, 569, 4/601, 596, 567, 604

(56) References Cited

U.S. PATENT DOCUMENTS

| | | | | |
|---|---|---|---|---|
| 3,630,193 A | * | 12/1971 | Lancaster | 4/601 |
| 4,055,863 A | * | 11/1977 | Duval | 4/601 |
| 4,796,312 A | * | 1/1989 | Corlew | 4/555 |
| 5,136,735 A | * | 8/1992 | Zimmerman | 4/597 |

FOREIGN PATENT DOCUMENTS

| | | | | |
|---|---|---|---|---|
| GB | 1598658 | * | 9/1981 | 4/601 |

* cited by examiner

*Primary Examiner*—Robert M. Fetsuga
(74) *Attorney, Agent, or Firm*—Waddey & Patterson; Mark J. Patterson; Guy W. Hensley

(57) ABSTRACT

A therapeutic shower for the physically impaired comprises a shower enclosure unit mounted on wheels and size to fit trough the standard door opening of most rooms found in a home and a rolling chair. Multiple water jets and adjustable valves inside the enclosure provide a showering spray of either water or water combined with medical or cleansing solutions to every part of the body except the face or head. The water jets are arranged and directed in a surrounding pattern and spaced such that the spray patterns of the jets effectively spray the entire body of the user without the need for the user to move around within the enclosure. The floor of the enclosure includes a drain assisted by a drain pump.

12 Claims, 3 Drawing Sheets

THERAPEUTIC SHOWER

FIELD OF INVENTION

The subject invention is directed to a transportable medical shower for the elderly, handicap patients, burn patients, patients with bed sores, quadriplegics, and more particularly, any person who cannot bathe themselves or find it difficult to use a standard shower.

BACKGROUND OF THE INVENTION

A need exists for a means of giving physically impaired people, such as the elderly, handicap patients, burn patients, patients with bed sores, quadriplegics, etc., the freedom and dignity to effectively administer their own oral hygiene. These persons are greatly dependent upon assistance of physically capable people such as nurses and therapists to administer their daily hygiene needs. Current technology, such as shower and bathtub seats and handheld shower spray systems, somewhat improve the bathing and showering systems, but users often still need assistance with getting in and out of the facility and assistance with the hygiene process itself. Such assistance is often frustrating and embarrassing to the individual. Many physically impaired people prefer some measure of independence in their daily routines, but certain things are not doable with the current technology found in home bathing and showering systems. Many quality of life improving products for bathing and showering are designed for institutions such as hospitals and nursing homes. Such buildings were built with special construction features that allow for the installation of this equipment. Seldom is a home or other such residence constructed to accept these special units. Therefore, the development of such an appliance should also consider the likely building construction limitations found in a typical home. These would include, but are not limited to level wood and concrete floors, water supply and drainage access, and standard doorway widths.

Additionally, such an appliance would need to have other considerations, which enhance the function and versatility of the unit. These would include but are not limited to features such as height adjustable shower chair designed to roll in and out of the unit without obstruction, a solution dispensing system to disperse medicinal and cleansing solutions into the unit's occupant, and user friendly controls for the entire system. The invention summarized and described below is the first invention of its kind to meet these needs.

SUMMARY OF THE INVENTION

Briefly summarized, the present invention in one broad aspect is a therapeutic shower enclosure unit mounted on wheels and sized to fit through the standard door opening of most rooms found in a home. The therapeutic shower requires no building modifications and does not require a professional installer to set-up or install the unit. Plumbing and electrical connections of the unit require no special tools. The therapeutic shower is designed for physically impaired people such as the elderly, handicapped and medical patients who seek assistance-free personal hygiene.

The therapeutic shower is designed for a person to sit inside the unit's enclosure surrounded by multiple water jets that provide a showering spray of either water or water combined with medicinal or cleansing solutions to every part of the body except the face and head. The water jets are arranged and directed in a body surrounding pattern and spaced such that the spray patterns of the jets effectively spray the entire body of the user without the need for the user to move around within the enclosure.

The top of the therapeutic shower is designed so that the user's head is above the unit and out of the spray zone. The top has a large opening at the entrance to the enclosure. This opening is to provide unobstructed ingress and egress to the therapeutic shower by the use of specially designed wheeled shower chair. This height adjustable chair is designed to accommodate a person of any size. The shower chair has multiple non-swivel wheels. The shower basin has a ramp attachment to facilitate rolling the chair in and out of the shower enclosure. A hinged door is attached to the side of the enclosure to close off the entrance during use; thus retaining any over-spray caused by the shower jets.

The supply of water can be achieved by various combinations of hose connections. For sink applications with a single "goose-neck" faucet, a universal adapter is used to make a non-permanent connection to the gooseneck. For dual faucet connections, such as the faucets supplying water to a clothes washer, a two hose system is used to supply water to the unit. Permanent hard connections are also an option.

The drain system utilizes a collection basin to accumulate the used water by means of a sloped floor surface. The accumulated water is funneled through a drain and into the inlet of a water pump. The water pump evacuates the used water and pumps the water through a discharge hose and into a sink drain or other drain system.

The application of the present invention therefore provides a therapeutic shower that can be used in buildings where there is hot and cold- water availability, such as a bathroom, kitchen or laundry area. The application of the present invention also provides that the unit can be installed without the use of a professional installer or special tools and that the therapeutic shower is specifically designed to be transportable and to fit through any standard door openings of most homes or similar structure.

BRIEF DESCRIPTION OF DRAWINGS

These and other objects, features and advantages of the invention will be evident from the following detailed description when read in conjunction with the accompanying drawings where like reference numerals represent like elements or symbols and in which.

DETAILED DESCRIPTION OF THE INVENTION

Figure 1:
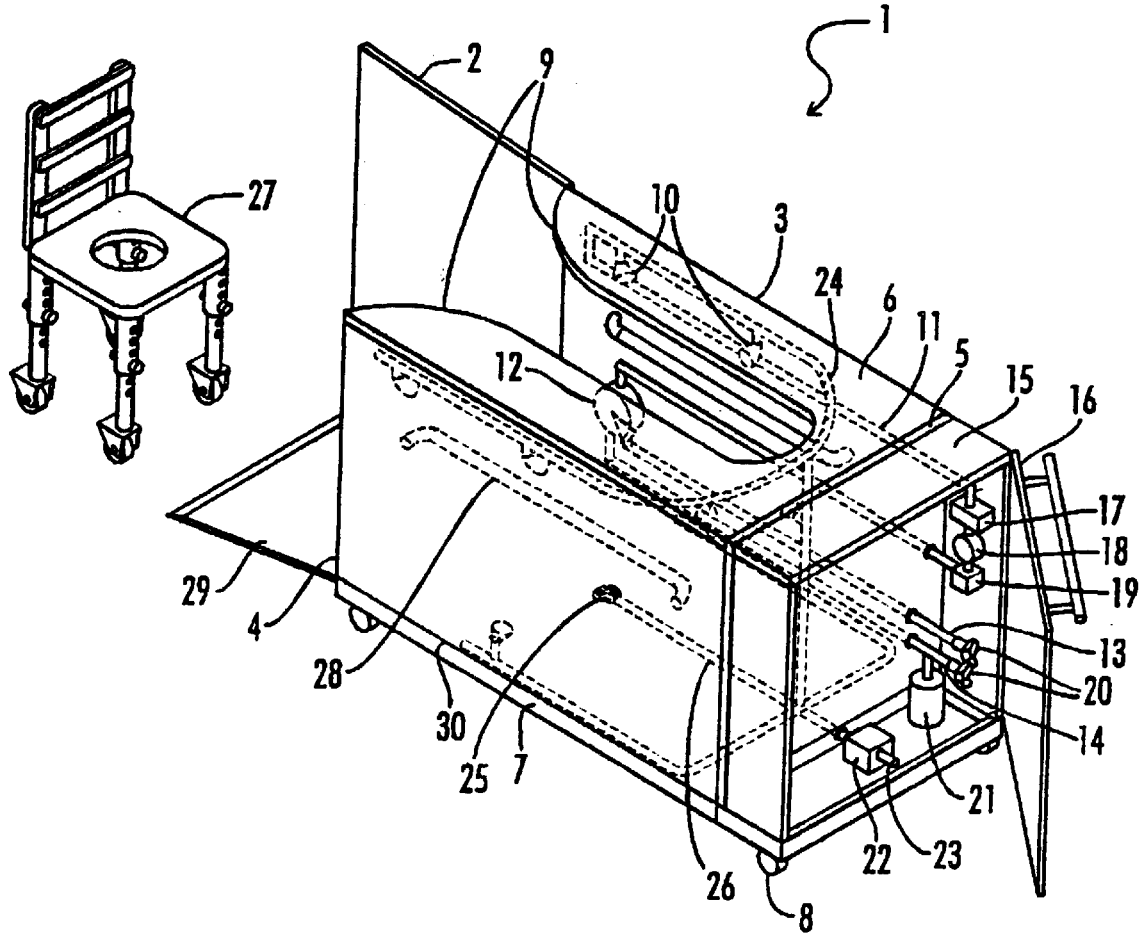
FIG. 1 is a perspective view of one embodiment of the internal and external components of the therapeutic shower, with the chair shown outside the enclosure and the internal components shown in phantom view.

Referring now to FIG. 1 where one preferred embodiment of the invention is illustrated, the therapeutic shower in accordance with the invention includes a shower enclosure 1 with a front door 2, sides 3 and 4, back wall 5, top 6, basin 7 and wheels 8. The top 6 has an opening 9, which makes it easy for a person to get in and out of therapeutic shower.

The internal plumbing of the therapeutic shower is made up of multiple water jets 10 located inside the enclosure 1 at the top 6, and located in the upper and lower portion of sides 3 and 4, and located in the upper and lower portions of back wall 5. The water jets 10 are connected to a common water line 11 contained within sides 3 and 4 and back wall 5. A lever control valve 12 is located inside the enclosure 1 on side 3. The cold water line 13 and hot water line 14 are also located within enclosure side 3 connecting to lever control valve 12 and extending into the mechanical compartment 15 which is formed by sides 3 and 4, the top 6, back wall 5, and the rear door 16.

The components located inside the mechanical compartment 15 are the vacuum breaker 17, regulator 18, circulating pump 19, shut off valves 20, medicine dispenser 21, drain pump 22 and drain line 23. The opening 9 in top 6 contains a curved perforated tube 24 which is also connected to water line 11. The drain 25 is located in basin 7 and is connected to drain tube 26 which is connected to drain pump 22 which is connected to drain line 23.

Still referring to FIG. 1, an adjustable chair 27 is provided to fit within shower enclosure 1. Handicap bars 28 are attached to sides 3 and 4 on the inside of the enclosure 1. A ramp 29 is affixed to the basin 7 at the opening of the enclosure for the front door 2. The ramp 29 slopes to the floor for ingress and egress of adjustable chair 27.

Figure 2:
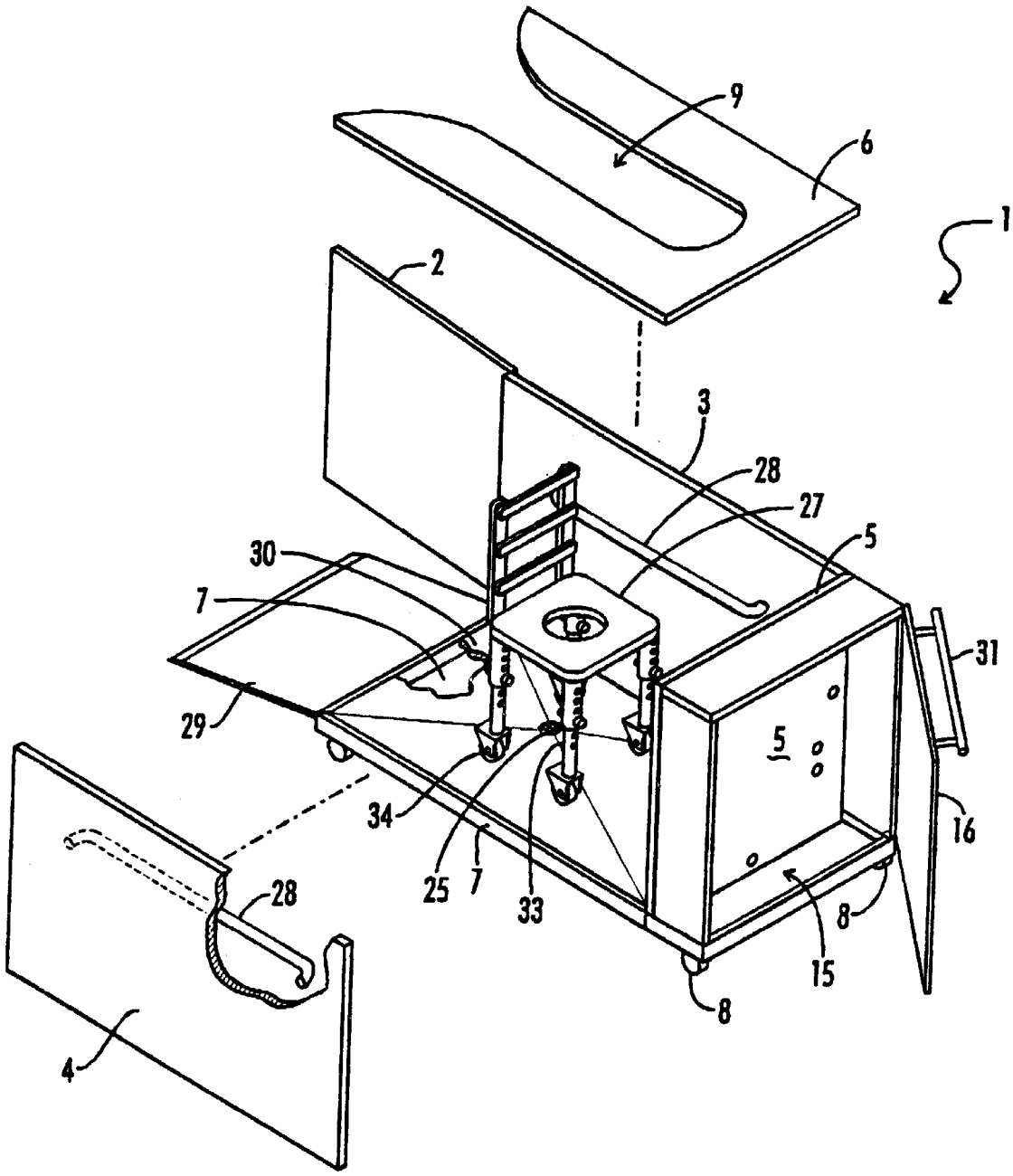
FIG. 2 is an exploded, partially separated and broken away perspective view of the enclosure with an internal view of the adjustable chair and drainage basin shown in FIG. 1.

FIG. 2 represents the shower enclosure 1 shown in FIG. 1 without all of the internal plumbing and mechanical components. This shower enclosure 1 can be made of various materials that provide structural support such as wood, plastic or metal. The handicap bars 28 are preferably made of a non-corrosive material and are mounted to the enclosure walls 3 and 4. The therapeutic shower has a mechanical compartment 15 that is accessed through the door 16. The mechanical and electrical components of the unit are located in this compartment 15. The enclosure back wall 5 separates the shower enclosure unit 1 from the mechanical and electrical components. The basin 7 is a structural component with a sloping floor 30 and wheels 8. The sloping floor 30 provides natural basin 7 drainage into drain 25. The wheels 8 are attached to bottom of basin 7 for moving the therapeutic shower within a building. A push bar 31 is attached to the rear door 16 of the outside of enclosure 1 to facilitate moving the therapeutic shower.

Figure 3:
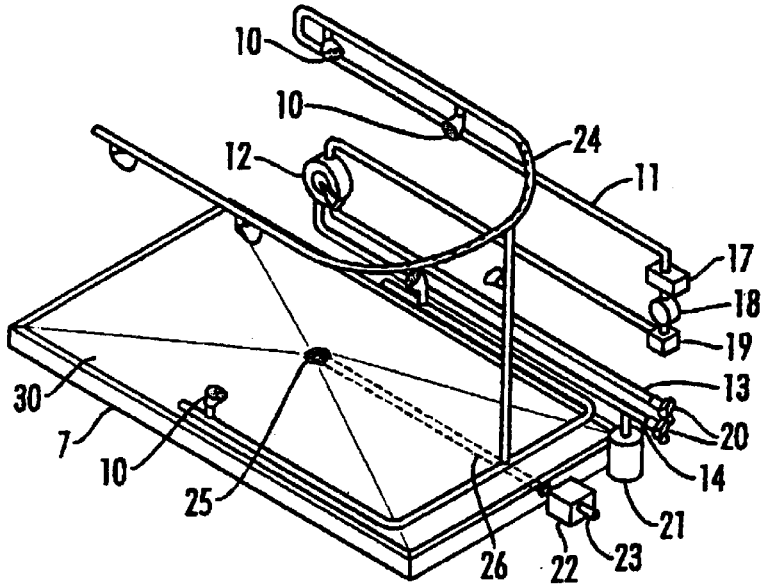
FIG. 3 is a perspective view of the plumbing and floor of the enclosure in FIG. 1.

FIG. 3 represents the plumbing system shown in FIG. 1 without the enclosure 1. All plumbing within the therapeutic shower are of standard dimensional sizes. A solution medicine dispenser 21 is connected to water line 11. The solution mixing dispenser 21 is controlled by the lever control valve 12 which regulates the amount of solution that flows through water jets 10.

Figure 4:
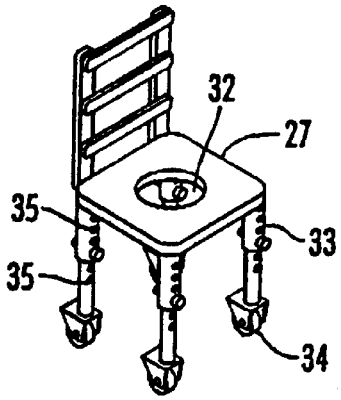
FIG. 4 is a perspective view of the chair used in FIG. 1.

FIG. 4 represents the top 6 shown FIG. 1. The top 6 is designed with an opening 9 which makes it easy to enter and exit the unit and to accommodate the neck of a human so the head can be kept above the spray zone. The top 6 is made of a light structurally sound material.

Figure 5:
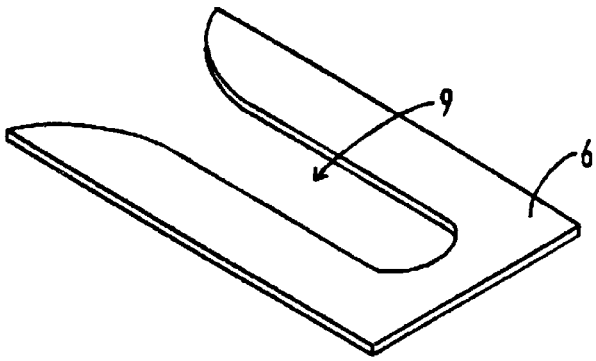
FIG. 5 is a perspective view of the top panel of the enclosure shown in FIG. 1.

FIG. 5 represents the adjustable chair 27 with a hole 32 in the seat equipped with adjustable legs 33 and chair wheels 34. The adjustable chair 27 is made of a light but strong materials. The adjustable legs 33 have incremental adjustment holes 35 (or notches) to accommodate various size persons.

Thus, although there have been described particular embodiments of the present invention of a new and useful therapeutic shower, it is not intended that such references be construed as limitations upon the scope of this invention except as set forth in the following claims.

What is claimed is:

1. A portable shower apparatus for providing a first fluid to the body of a user, said shower apparatus comprising:

a chair for supporting the body of the user, said chair having a plurality of legs, each of said legs including means for adjusting its height and a wheel for allowing rollable movement of said chair;

an enclosure in the form of a chamber for receiving said chair and the body of the user, said chamber having an interior, at least one wall, and a floor having a discharge drain therein, said floor being sloped toward said discharge drain for gravitationally directing the used first fluid toward and out of said fluid discharge drain and being adapted for receiving and supporting said chair and the body of the user;

means associated with said chamber for providing ingress to and egress from said chamber, said means including a door within said at least one wall and a sloped ramp leading to said interior of said chamber;

conduit means within said chamber for directing the first fluid to the body of the user, said conduit means including at least one spray nozzle secured to said at least one wall of said chamber;

a source of the first fluid under pressure connected to and in communication with said conduit means;

valve means within said conduit means of said chamber which allows the user to operate and self-provide said first fluid to the body of the user; and means in communication with said discharge drain for assisting in the withdrawal of said used first fluid from said floor of said chamber.

2. The portable shower apparatus of claim 1 wherein a solution-mixing dispenser is connected to said conduit means for adding and mixing a second fluid to said first fluid being directed through said conduit means to the body of the user.

3. The portable shower apparatus of claim 2 wherein said valve means incorporates structure which permits the selective and discrete introduction of said second fluid to said first fluid within said conduit means for distribution on the body of the user.

4. The portable shower apparatus of claim 3 wherein said at least one spray nozzle is a minimum of four such nozzles within said conduit means and being spaced throughout said interior of said chamber.

5. The portable shower apparatus of claim 4 wherein said chamber further includes a top with an opening therein sufficient in size to allow the head of a user to protrude from the chamber during the showering process.

6. The portable shower apparatus of claim 5 wherein said chamber has a plurality of wheels outside of said chamber adjacent said floor and at least one handrail on said at least one wall of said chamber for grasping and assisting in the movement of the user within said chamber.

7. The portable shower apparatus of claim 6 wherein said conduit means includes a battery powered fluid circulation pump for enhancing the pressure of fluid being directed to said minimum of four spray nozzles.

8. A portable shower apparatus for providing selective fluids to the body of a user, said shower apparatus comprising:

a chair for supporting the body of the user, said chair having a plurality of legs, each of said legs including means for adjusting its height and a wheel for allowing movement of said chair;

an enclosure in the form of a chamber for receiving said chair and the body of the user, said chamber having an interior, a pair of side walls having upper and lower sections, a rear wall, a front wall, a top wall with an opening therein sufficient in size to allow the head of a user to protrude from said chamber, and a floor having a discharge drain therein and being sloped toward said discharge drain for gravitationally directing used said fluids toward and out of said discharge drain, said floor being adapted for receiving and supporting said chair and the body of the user;

means associated with said chamber for providing ingress to and egress from said chamber, said means including a sloped ramp leading to said interior of said chamber;

conduit means within said chamber for directing one or more selective fluids to the body of the user, said conduit means including a minimum of four spray nozzles secured to said side walls of said chamber, with a minimum of two said spray nozzles being secured to said upper section of at least one of said side walls and a minimum of two said spray nozzles being secured to said lower section of at least one of said side walls;

a source of a first fluid under pressure connected to and in communication with said conduit means;

a source of a second fluid under pressure connected to and in communication with said conduit means;

valve means within said conduit means of said chamber which allows the user to operate and self-provide on a selective basis said first and second fluids to the body of the user; and means in communication with said discharge drain for assisting in the withdrawal of said used fluid from said floor of said chamber.

9. The portable shower apparatus of claim 8 wherein a solution-mixing dispenser is connected to said conduit means for adding and mixing said second fluid to said conduit means and directing same to the body of the user.

10. The portable shower apparatus of claim 9 wherein said valve means incorporates structure which permits the selective and discrete introduction of said second fluid to said conduit means for distribution on the body of the user.

11. The portable shower apparatus of claim 10 wherein said chamber has a plurality of wheels adjacent said floor and at least one handrail secured to one of said side walls of said chamber for grasping and assisting in the movement of the user within said chamber.

12. The portable shower apparatus of claim 11 wherein said conduit means includes a battery powered fluid circulation pump for enhancing the pressure of fluid being directed to said minimum of four spray nozzles.

* * * * *